United States Patent [19]

Grove

[11] 4,132,040

[45] Jan. 2, 1979

[54] MULTI-SECTION LIFTING BOOM

[75] Inventor: John L. Grove, Greencastle, Pa.

[73] Assignee: JLG Industries, Inc., McConnellsburg, Pa.

[21] Appl. No.: 796,381

[22] Filed: May 12, 1977

[51] Int. Cl.[2] ..... B66C 23/04

[52] U.S. Cl. ..... 52/115; 52/121; 212/55; 92/165 R

[58] Field of Search ..... 52/115, 118, 121; 212/46 B, 55, 57, 144; 92/117, 137, 126, 165 R

[56] References Cited

U.S. PATENT DOCUMENTS

| | | | |
|---|---|---|---|
| 3,431,825 | 3/1969 | Crauley et al. | 92/165 R |
| 3,722,154 | 3/1973 | Sakamoto et al. | 52/121 |
| 3,792,555 | 2/1974 | Sung | 52/115 |
| 3,796,016 | 3/1974 | Wu | 52/115 X |
| 3,837,502 | 9/1974 | Hornagold | 212/55 |
| 3,842,985 | 10/1974 | Svede | 212/55 |
| 3,889,818 | 6/1975 | Wennerstrom | 212/55 |
| 4,016,688 | 4/1977 | Tiffin et al. | 52/115 X |

*Primary Examiner*—J. Karl Bell
*Attorney, Agent, or Firm*—Irvin A. Lavine

[57] ABSTRACT

A lifting boom having three telescopic sections. A hydraulic ram has the piston rod free end connected by a horizontal pin movable in guide slots at the rear of the base section. A deflection limiter is axially slidable on the piston rod, and is less high then the base section. The rear of the ram cylinder is pin connected by horizontal pins to the mid section, and has a transverse ram cylinder plate attached to it. Pull rods are connected to the deflection limiter and pass forwardly through the transverse plate, having detents at their forward ends beyond the transverse plates. A pair of chains extends from the base section forward and around sprockets at the rear of the mid section, being attached to the rear of the fly section, a further chain extending thence forwardly and around a sprocket on the front end of the ram cylinder, and thence rearwardly to an anchor on the base section; the ram sprocket has a roller portion which rolls on the fly section bottom plate to support the ram cylinder. The heel of the fly section raises the ram forward end when the boom is extended and the sections are cocked or arched, limited by the roller engaging the bottom of the fly section top plate.

31 Claims, 4 Drawing Figures

MULTI-SECTION LIFTING BOOM

The present invention relates to a multi-section lifting boom, useful in such apparatus as cranes and aerial lift platforms.

Lifting booms for cranes and aerial lift platforms typically are made of multiple, extensible telescopic sections. Extention and retraction is effected by one or more hydraulic cylinders, or a combination of hydraulic cylinders and cable or chains trained over pulleys or sprockets.

When the booms are extended, and are under load, they tend to depart from a theoretical arrangement in which the boom sections are in alignment with each other. This is known as arching or cocking, and steps have been taken in the art to avoid harmful effects thereof.

Another problem which has been recognized is that if the boom sections cock relative to each other, there is a strain placed upon the hydraulic ram which extends and retracts the boom sections, leading to damage to the ram, such as occurs when the piston rod buckles under compressive loads, since it acts as a long column, and also has the harmful effect of deteriorating the seals of the hydraulic ram. In addition, there have been proposals for providing great strength, with minimum utilization of metal.

Various relavent disclosures are present in the prior art. Thus, Sterner U.S. Pat. No. 3,736,710 discloses a four section telescopic crane boom which utilizes three single piston rams, one of which has the cylinder pin-connected at its rear end to a boom mid section, and extending forwardly, the forward end of the cylinder resting on a slide-bearing arrangement, the piston rod extending rearwardly, and having its free end connected to the boom base section by a floating arrangement allowing the end of the piston rod to move transversely of the boom longitudinal axis.

Sakamoto et al U.S. Pat. No. 3,722,154 discloses a construction in which the piston rod of the hydraulic ram of a multi-section telescopic boom has a buckle-preventing device slidable thereon, and comprising outwardly extending portions which movably engage with the inside surfaces of the relavant boom section, such as with the bottom of the base section upper plate and the top of the base section bottom plate. The piston rod is pin-connected to one section of the boom, and the cylinder is pin-connected to another section of the boom. This construction severely limits the amount of cocking of the boom sections which can be tolerated without damage to the hydraulic ram, and appears to actually increase the load on the hydraulic ram when the boom sections are in the cocked attitude, by virtue of the engagement of the buckle-preventing device continuously with the boom section.

Kollmann et al U.S. Pat. No. 3,715,039 discloses a telescopic boom having a plurality of boom sections, and a plurality of hydraulic rams in line, with the piston rod of one ram being pin-connected to the cylinder of an adjacent ram, and with a wheel structure mounted on the connecting pin, the wheel structure being supported by the boom section to thereby support the pin connection.

There is provided herein a lifting boom which comprises three telescopic sections, which are linearly extensible and retractable. A single hydraulic ram is utilized, having a piston rod free end which is connected by a horizontal pin to the rear of the base section of the boom, the connection being a "floating" connection, since the horizontal pin is movable in generally vertical extending guide slots provided at the rear of the boom base section. A deflection limiting device is slidable along the piston rod, and is less high than the base section, the top of the deflection limiter being spaced from the bottom of the boom top plate when the boom is not under load, but being in engagement therewith when the boom is extended and is under load. The rear of the ram cylinder has a ram cylinder plate welded to it, and extending transversely of its axis, the plate comprising horizontal pins which pin-connect the plate and therefore the ram cylinder to the mid section. Pull rods are provided for moving the deflection limiter, the rear ends of the pull rods extending through a transverse plate of the deflection limiter, having nuts on their rear ends, the pull rods passing forwardly through the transverse plate of the deflection limiter and through the ram cylinder plate. The forward ends of the pull rods have nuts or other detents thereon, so that when the hydraulic ram has been extended, the front face of the ram cylinder plate will engage the nuts or detents on the forward ends of the pull rods, and pull the deflection limiter along the piston rod of the hydraulic ram. A pair of chains extends from the forward end of the base section; of the bottom plate thereof, rearwardly, passing around sprockets carried at the rear end of the mid section, and is attached to the rear of the fly section; a second chain extends forwardly, passing around the forward end of the hydraulic ram. A combined sprocket and roller is carried by the forward end of the hydraulic ram, and the chain passes on this sprocket and thence rearwardly to an anchor at the rear of the base section. The combined sprocket and roller rolls on the bottom plate of the fly section, to support the forward end of the ram cylinder, during the boom extension, and when fully extended the heel of the fly section engages the ram cylinder at the bottom of the forward end, rotating it on its pivots, rotation being limited by engagement of the roller with the top of the fly section, that is, the upper plate thereof. This also serves to reduce buckling stresses on the piston rod.

The present invention has as objects the provision of apparatus for permitting limited buckling of the piston rod, to provide such limited buckling with a cylinder mounted for pivoting movement at its rear end, and having the free end of the piston rod floatingly connected to the base section, and a further object of the present invention is to provide a construction in which a hydraulic ram cylinder is pivoted at its rear end, and has its front end supported by a combined roller and pulley device, which also serves to limit upward rotation of the ram cylinder.

IN THE DRAWINGS

Figure 1:
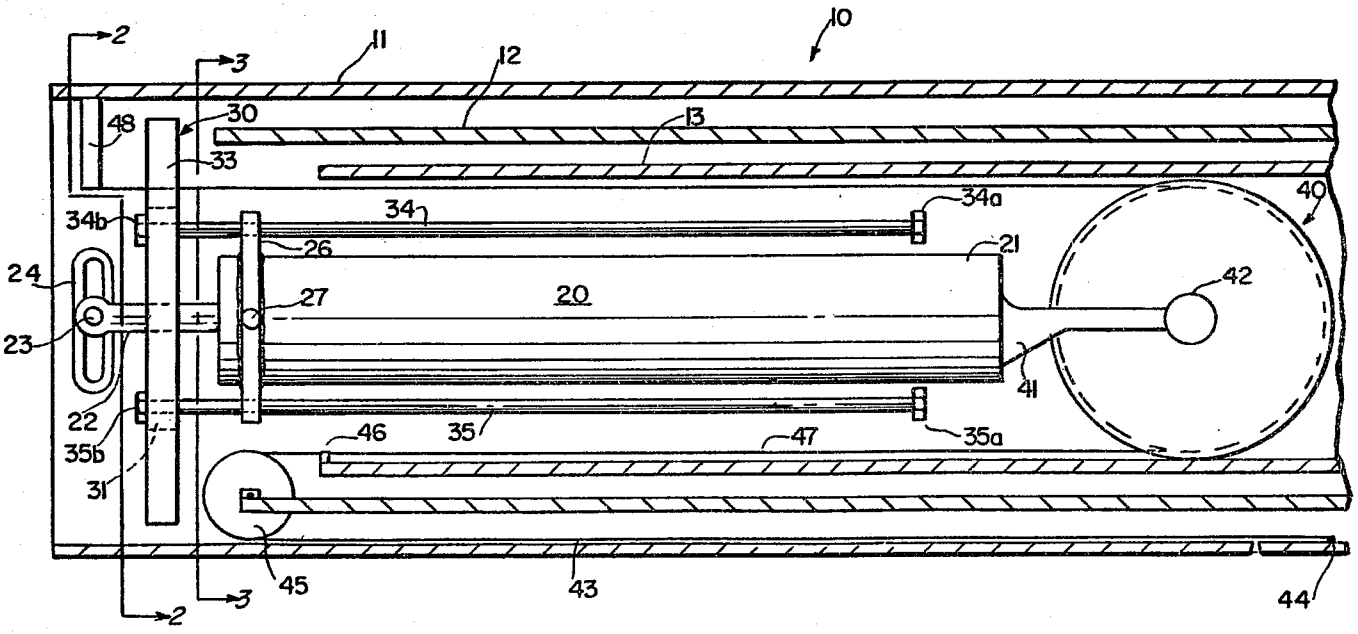
FIG. 1 is a vertical cross sectional view of a lifting boom in accordance with the present invention.
Figure 3:
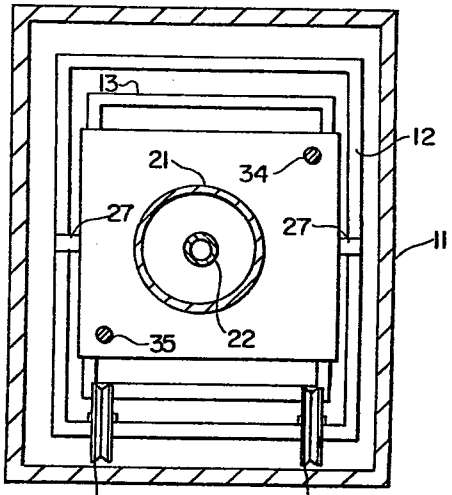
FIG. 3 is a cross sectional view taken on the line 3—3 of FIG. 1.

Referring now to the drawings, wherein like or corresponding reference numerals are used to designate like or corresponding parts through out the several views, there is shown in FIG. 1 a multi-section lifting boom suitable for cranes and aerial lift platforms, designated 10, and comprising a base section 11, a mid section 12 and a fly section 13. These sections may take various cross sectional shapes, but in the herein disclosed preferred embodiment, each section is a generally hollow rectangle in transverse cross section, as is apparent from FIGS. 2 and 3.

A hydraulic ram 20 is provided, ram 20 being in a position which is inverted from that which is normal; thus, the ram 20 includes the hydraulic cylinder 21 which extends forwardly, and the piston rod 22, which extends rearwardly. At its rear end, piston rod 22 has a transverse pin 23, which is in a horizontal plane, and the ends of which are positioned in a guide 24 which permit the pin 23 and therefore the end of the piston rod 22 to have limited movement in a vertical plane transverse to the boom longitudinal axis.

A ram cylinder plate 26 is welded at the rear end of the cylinder 21 of hydraulic ram 20, the hydraulic ram plate 26 including transversely extending pins 27, which are horizontal, and which are journalled in a suitable openings in the mid section 12.

Figure 2:
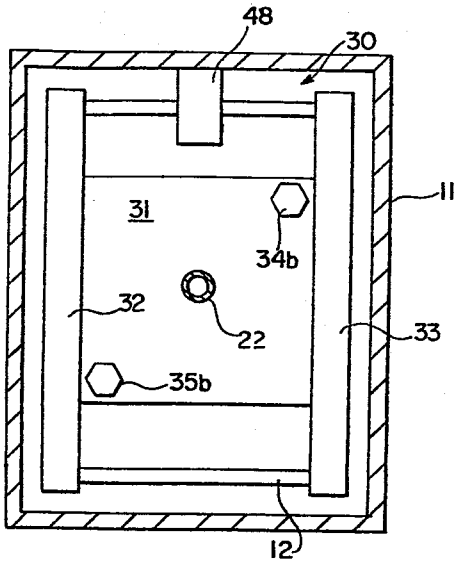
FIG. 2 is a cross sectional view taken on the line 2—2 of FIG. 1.

A device 30 is provided for permitting limited movement or buckling of piston rod 22, and comprises, as shown in FIG. 2, a transverse limiter plate 31 having an aperture therein through which the piston rod 22 passes, there being sliding engagement between transverse limiter plate 31 and the exterior of piston rod 22. A pair of vertical limiter plates 32 and 33 are connected to the transverse limiter plate 31, and as is clearly shown in FIG. 2, these vertical limiter plates 32 and 33 stop short of engagement with the bottom of the top plate of boom base section 11 in the condition in which the boom is not loaded. Pull rods 34 and 35 extend generally axially, there being provided at the forward ends of pull rods 34 and 35 detents **34*a* and 35*b*, which may take the form of nuts. At their rear ends, the rods 34 and 35 pass through apertures in the transverse limiter plate 31, where enlargements, such as the nuts 34*b* and 35*b* are provided. When the hydraulic ram 20 is extended to the right, the ram cylinder plate 26 moves with it, moving the mid section 12, and the ram cylinder plate 26 passes along the pull rods 34 and 35 until the front thereof engages the rear of the nuts or detends 34*a* and 35*a*, after which the piston rod buckle limiter 30 is pulled along the piston rod 22. The dimensional relationships are such that in the fully extended position of the hydraulic ram 20, the piston rod buckle limiter 30 is approximately at the mid point of the piston rod 22**.

A combination roller-sprocket 40 is provided, supported on a support 41 which extends forwardly from the forward end of a cylinder 21, and carries an axle 42. Preferably, the support 41 is bifurcated. The outer surface of the combination roller-sprocket 40 has parallel wheels which serve as a roller, being in engagement with the upper surface of the bottom plate of the fly section 13 during initial extension of the boom. The combination roller-sprocket 40 has the sprocket part thereof of slightly lesser effective diameter than the parallel wheels forming the roller, as indicated by dashed lines, to accommodate the thickness of a chain.

A pair of chains 43 extend rearwardly from an anchor 44 which is positioned at the front end of the bottom plate of the base section 11. The chains 43 pass around sprockets 45 carried at the rear of the mid section 12, and thence to an anchor 46 on the rear of the fly section 13. A chain 47 passes from the anchor 46 forwardly, and around the combination roller-sprocket 40, and thence extends rearwardly to the anchor 48 which is located on the upper plate of the boom base section 11.

Figure 4:
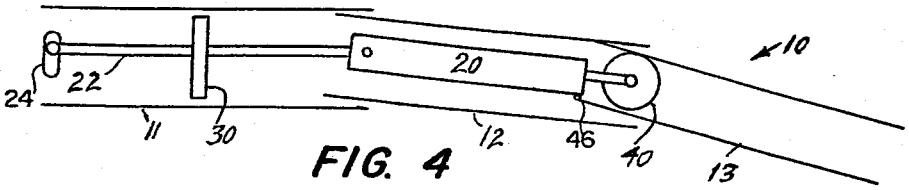
FIG. 4 is a view of the boom of FIG. 1 in arched condition.

When the boom 10 is extended and is under load as shown in FIG. 4, arching or cocking of the boom sections relative to each other will not result in harmful effect to the hydraulic ram 20, due to the floating connection of the free end of the piston rod 22, and the pin connection of the cylinder 21 to the boom mid section 12. In addition, the forward end of the cylinder 21 is supported by the combination roller sprocket 40, which supports the forward end of the hydraulic ram 20, and serves as a guide for the chain 47. In addition, the arching or cocking of the sections will not damage the hydraulic ram 20, and particularly the piston rod 22 thereof, because the piston rod 22 will be permitted a limited, predetermined amount of buckling, due to the spacing of the upper end of the vertical limiter plates 32 and 33 from the bottom surface of the top plate of the boom base section 11, this spacing permitting arching or cocking without transmission to the piston rod 22 of undesirable loads, and without providing a harmful effect on the seals where the piston rod 22 passes through the left or inner end of the cylinder 21.

With further reference to the condition of the boom as shown in FIG. 4, in which the boom sections are fully extended, and are under load, arching or cocking as illustrated therein will occur. The heel of the boom fly section 13, or more particularly the anchor 46 which is at the heel thereof will engage the cylinder 21 of the hydraulic ram 20 at the bottom of the forward end thereof. The heel of the fly section is that portion which is at the rear of the fly section. This will rotate the cylinder 21 about the axis provided by the pins 27, the rotation being to a limited amount as determined by the engagement of the combination roller-sprocket 40 with the bottom of the top plate of the fly section 13. As will be understood, the diameter of the roller-sprocket 40 is slightly less than the vertical height of the space provided by the fly section 13, and more particularly is slightly less than the space between the top of the bottom plate and the bottom of the top plate of fly section 13. This construction will thereby serve to enable the cylinder 21 to be rotated in a direction to reduce the stresses tending to buckle the piston rod 22, and thereby further serves to avoid harmful effects of arching or cocking of the boom sections when extended and loaded on the ram 20, including particularly the piston rod 22 thereof.

It will be obvious to those skilled in the art that various changes may be made without departing from the spirit of the invention, and therefore the invention is not limited to what is shown in the drawings and described in the specification but only as indicated in the appended claims.

I claim:

1. A multi-section lifting boom for cranes or the like comprising:

base, mid and fly sections in telescopic relation, a hydraulic ram having a cylinder and piston rod, means connecting the free end of the piston rod to the rear of the boom base section for movement transversely of the boom axis, means connecting the ram cylinder to the boom mid section for movement of at least part of said ram relative thereto, chain means for extending and retracting the boom fly section upon extension and retraction of said hydraulic ram, and a combined sprocket and roller rotatably supported from the forward end of the hydraulic ram, said chain means trained over said sprocket of said sprocket and roller, and said sprocket and roller being in rolling contact with the said fly section.

2. The multi-section lifting boom of claim 1, wherein said sprocket and roller has the roller thereof in rolling contact with the bottom of the fly section.

3. The multi-section lifting boom of claim 2, said cylinder having a forwardly directed extension at the forward end thereof, a horizontal axle carried by said extension, and said sprocket and roller journalled on said horizontal axle.

4. The multi-section lifting boom of claim 1, said cylinder having a forwardly directed extension at the forward end thereof, a horizontal axle carried by said extension, and said sprocket and roller journalled on said horizontal axle.

5. The multi-section lifting boom of claim 1, said chain means having one end attached to the forward end of the base section and extending rearwardly to sprocket means carried at the rear of the mid-section and thence forwardly to an anchor at the rear of the fly section, and chain means from said anchor to said combination sprocket and roller, and then rearwardly to an anchor at the rear of the base section.

6. The multi-section lifting boom of claim 1, and means for permitting limited deflection of the piston rod of said hydraulic ram when said ram is extended, said means restricting deflection of said piston rod greater than a predetermined amount.

7. The multi-section lifting boom of claim 6, said deflection limiting means comprising plate means slidable on said piston rod and being vertically spaced from the top of the base section when the boom is not loaded, and engaging the top of the base section when said boom is loaded.

8. The boom of claim 7, said deflection limiting means further comprising link means engageable with said plate means and a movable element of said boom for pulling said plate means along said piston rod to a position at approximately one-half the extended length thereof.

9. The boom of claim 7, said deflection limiting means further comprising rod means extending forwardly from said plate means, and coacting means on said rod means forward end and the rear portion of said cylinder means for pulling said rod means forward after extension movement of said cylinder.

10. The boom of claim 6, wherein said pin connecting means includes a ram cylinder plate connected to the rear of the ram cylinder, wherein said deflecting limiting means comprises rod means extending through apertures in said ram cylinder plate and having enlargements on the forward end thereof larger than said apertures.

11. The multi-section lifting boom of claim 1, wherein said sprocket and roller has a diameter less than the vertical space in said fly section, and rolls upon the bottom of the fly section during extension of said boom, and wherein upon cocking of said boom when extended, the heel of the fly section engages the ram and pivots the ram about the pivoted connector thereof, the pulley and roller engaging the top of the fly section to limit piston rod buckling.

12. The multi-section lifting boom of claim 1, wherein said means connecting the ram cylinder to the boom mid-section comprises horizontal pins.

13. The multi-section boom of claim 11, and means for engaging said piston rod and a part of said boom when said boom is extended for limiting the deflection of said piston rod to a predetermined amount after initial deflection thereof.

14. A multi-section lifting boom for cranes or the like comprising:

base, mid and fly sections in telescopic relation, a hydraulic ram having a cylinder and piston rod, means connecting the free end of the piston rod to the rear of the boom base section for movement transversely of the boom axis, means connecting the ram cylinder to the boom mid section for movement of at least part of said ram relative thereto, chain means for extending and retracting the boom fly section upon extension and retraction of said hydraulic ram, means for supporting the forward part of the hydraulic ram on said fly section, said mid and fly sections cocking when extended, and means for moving the forward end of the hydraulic ram upwardly a predetermined amount, whereby to relieve buckling stresses on said piston rod.

15. The multi-section lifting boom of claim 14, wherein the last mentioned means comprises means at the heel of the fly section for engaging the lower forward portion of said ram cylinder.

16. The multi-section lifting boom of claim 14, wherein said ram supporting means comprises a roller at the forward end of the hydraulic ram having a diameter less than the vertical spaces in said fly section, said roller engaging the top of the fly section and thereby limiting the rotation of the forward end of the hydraulic ram by said means at the heel of the fly section.

17. The multi-section boom of claim 16, wherein said roller has a sprocket coaxial therewith, said chain means extending around said sprocket.

18. The multi-section lifting boom of claim 14, wherein said means connecting the ram cylinder to the boom mid-section comprises horizontal pins.

19. A multi-section lifting boom for cranes or the like comprising:

at least two sections in telescopic relation, a hydraulic ram having a cylinder and piston rod, means connecting said cylinder to one said section and said piston rod to the other said section, for extension and retraction of one said section relative to the other, said piston rod being subject to deflection when said hydraulic ram is extended and said boom is under load, and means for limiting the deflection of said piston rod to a predetermined amount after initial deflection when said ram is extended and said boom is under load comprising:

means slidable on said piston rod, said means being engageable with an element of said boom after said initial deflection of said piston rod.

20. The boom of claim 19, said means slidable on said piston rod comprising vertically extending means having the upper end thereof vertically spaced below the top of the boom when the hydraulic ram is retracted and engaging said top of the boom when the boom is extended and under load.

21. The boom of claim 19, and means connected to a movable element of said boom and to said slidable means for sliding said slidable means along said piston rod.

22. The boom of claim 19, said means connecting said cylinder to said one section comprising means permitting movement of said cylinder relative to said one boom section.

23. The boom of claim 22, said last mentioned means comprising horizontal pin means.

24. The boom of claim 23, said means connecting said piston rod to said other section comprising means permitting movement of the free end of said piston rod transversely of said boom axis.

25. The boom of claim 22 said means connecting said piston rod to said other section comprising means permitting movement of the free end of said piston rod transversely of said boom axis.

26. The boom of claim 19, at least one of said means connecting said cylinder and said piston rod to said respective boom sections permitting movement thereof relative to the boom section to which it is connected.

27. The boom of claim 26, wherein both said connecting means permit such movement.

28. A telescopic extensible and retractable lifting boom having a first fixed section and two movable sections, a linear fluid motor including a cylinder and piston rod, with the cylinder connected to the second section and the piston rod connected to the first section for extending and retracting the second section, and chain means for extending and retracting the third section, the improvement comprising;

a combined sprocket and roller, means supporting said sprocket and roller from the forward end of said fluid motor, said chain means extending in engagement with said sprocket, said roller of said sprocket and roller being in rolling contact with said third section of said boom.

29. A telescopic extensible and retractable load lifting boom having a first, fixed section and two movable sections, a linear fluid motor including a cylinder and a piston rod, means connecting the cylinder to the second section for movement of at least a part thereof in the vertical median plane of said second section relative to said second section, means connecting said piston rod to said first section, means for extending and retracting said third section upon extension and retraction movement of said second section, and means for relieving buckling stresses in said piston rod upon extension of said boom and cocking of said second and third sections comprising means for raising the forward end of said linear motor relative to said second section.

30. A boom according to claim 29, said means for raising the forward end of said linear motor comprising said boom third section.

31. In a multi-section lifting boom having at least two sections in telescopic relation and a hydraulic ram having a cylinder and piston rod each connected to one said section for extension and retraction of one said section relative to the other, and wherein said piston rod is subject to deflection when said hydraulic ram is extended and said boom is under load, the improvement comprising:

means for limiting the deflection of said piston rod to a predetermined amount after initial deflection thereof when said ram is extended and said boom is under load, said deflection limiting means comprising means movable along said piston rod, and means actuated by said ram cylinder for moving said deflection limiting means along said piston rod.

* * * * *